US006895758B2

(12) United States Patent
Knight

(10) Patent No.: US 6,895,758 B2
(45) Date of Patent: May 24, 2005

(54) FLUIDIC CONTROL OF FUEL FLOW

(75) Inventor: Peter Howard Knight, Broughton Astley (GB)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 10/348,730

(22) Filed: Jan. 22, 2003

(65) Prior Publication Data

US 2004/0020208 A1 Feb. 5, 2004

(30) Foreign Application Priority Data

Jan. 23, 2002 (GB) ..... 0201414

(51) Int. Cl.[7] ..... F02C 9/28
(52) U.S. Cl. ..... 60/773; 60/39.281
(58) Field of Search ..... 60/39.27, 39.281, 60/773

(56) References Cited

U.S. PATENT DOCUMENTS

| | | | | |
|---|---|---|---|---|
| 3,748,852 A | | 7/1973 | Cole et al. | |
| 3,795,104 A | * | 3/1974 | McLean | 60/39.281 |
| 3,937,195 A | | 2/1976 | Woods | |
| 4,393,651 A | * | 7/1983 | Peck et al. | 60/39.281 |
| 4,570,597 A | | 2/1986 | Snaper | |
| 5,938,421 A | | 8/1999 | George, II | |
| 6,343,927 B1 | | 2/2002 | Eroglu et al. | |
| 6,389,798 B1 | | 5/2002 | Tilston et al. | |

FOREIGN PATENT DOCUMENTS

| | | |
|---|---|---|
| EP | 0 672 862 A2 | 1/1995 |
| EP | 1 070 917 A1 | 7/2000 |
| GB | 1 439 918 | 7/1973 |
| GB | 2 202 000 A | 9/1988 |
| GB | 2 279 764 A | 1/1995 |

* cited by examiner

*Primary Examiner*—Louis J. Casaregola
(74) *Attorney, Agent, or Firm*—Kirschstein, et al.

(57) ABSTRACT

A fluidic apparatus for modulating the rate of fuel flow into the combustor of a gas turbine engine. The apparatus includes a fluidic oscillator device (preferably an astable fluidic oscillator, or "flip-flop") having a supply inlet connected to a fluid fuel source and a pair of outlets one of which is connected to the combustor. The fluidic device operates to output fluid fuel from the outlets alternately, so modulating fuel flow into the combustor.

20 Claims, 1 Drawing Sheet

FLUIDIC CONTROL OF FUEL FLOW

TECHNICAL FIELD

The present invention relates to fluidic apparatus, and in particular to fluidic apparatus for use in controlling fuel flow to the combustor of a gas turbine engine.

BACKGROUND OF THE INVENTION

All gas turbine engines include a combustor in which a mixture of fuel and air is burnt to produce exhaust gases that drive a turbine. To reduce the amount of harmful emissions such as nitrogen oxides (NOx) that are produced during combustion, most modern gas turbine engines burn a lean pre-mixture of fuel and air, without suppression of NOx by injection of water or steam into the combustion process. However, these sorts of dry low emission (DLE) gas turbine engines are particularly prone to acoustic vibrations and noise caused by variations in the gas pressure within the combustor. These pressure variations can have a frequency of 200 Hz or more, and in larger gas turbine engines the acoustic vibrations and noise can be so severe that the combustor is literally shaken to pieces.

One way of minimizing these pressure variations is to modulate the rate of delivery of the fuel flow into the combustor in a controlled manner such that the coupling mechanism which is responsible for the instability is disrupted. The present assignee has successfully modulated the fuel flow using a high bandwidth modulation valve that can operate at the necessary frequencies. The valve can be controlled to modulate a portion of the fuel flow into the combustor using a complex mathematical algorithm. However, such valves are very expensive and potentially unreliable. They also have a limited lifespan.

The purpose of the present invention is therefore to provide an alternative fluidic apparatus for modulating the rate of delivery of fuel flow into the combustor that is cheap to manufacture and very reliable.

Fluidic devices are well known to the skilled person and include bistable fluidic devices and astable (or "flip-flop") fluidic oscillators. The general principle of operation of bistable fluidic devices and astable fluidic oscillators is explained in *The Analysis and Design of Pneumatic Systems*, Blaine W. Anderson, John Wiley & Sons, Inc, 1967. In bistable fluidic devices a supply jet of liquid or gas can be made to exit from either of two outlets due to the Coanda effect. The Coanda effect is the tendency of a fluid jet to attach itself to, and flow along, a wall. In bistable fluidic devices the supply jet can be made to switch from one outlet to the other by the application of a relatively small control pressure. In astable fluidic oscillators the supply jet can be made to switch from one outlet to the other continuously.

FIG. 1 shows an example of a basic bistable fluidic device 1 that includes a supply inlet 2, a pair of diverging outlets 4, 6 and a pair of oppositely facing control inlets 8, 10. The supply jet 12 has a tendency to attach itself to the side wall of one or other of the diverging outlets 4, 6. In FIG. 1, the supply jet 12 is attached to the side wall of the left-hand outlet 4. When the supply jet 12 is exiting from the left-hand outlet 4 it can be switched to the right-hand outlet 6 by the application of a control pressure to the left-hand control inlet 8. The supply jet will then continue to exit from the right-hand outlet 6 until a control pressure is applied to the right-hand control inlet 10.

An astable (or "flip-flop") fluid oscillator can be made by connecting at least one of the diverging outlets to the control inlet on the same side. Thus, the left-hand outlet 4 can be connected to the left-hand control inlet 8, and/or the right-hand outlet 6 can be connected to the right-hand control inlet 10. The supply jet 12 can then be made to oscillate continuously so that it exits first from the left-hand outlet 4 and then from the right-hand outlet 6. The frequency of oscillation (i.e., the rate at which the supply jet oscillates between the pair of diverging outlets) depends on the length and capacity of the feedback path connecting the diverging outlets to the control inlets. Other factors that also influence the oscillation frequency include the width of the supply inlet 2, the pressure of the supply jet 12 and the angle between the pair of diverging outlets 4, 6.

SUMMARY OF THE INVENTION

The present invention provides a fluidic apparatus for modulating the rate of fluid fuel flow into a gas turbine engine combustor, the apparatus comprising a fluidic oscillator device having first and second outlet passages, a supply inlet passage and a junction at which the outlet and inlet passages meet, the inlet passage being connected to a fuel supply line, the first outlet passage being connected to a fuel discharge line for connection to the combustor, whereby in use the fluidic oscillator device outputs fuel from the first and second outlet passages alternately.

By modulating the rate of fuel flow into the combustor it is possible to disrupt a coupling mechanism which is responsible for combustion instability, thereby attenuating the variations in the gas pressure which cause the acoustic vibrations and noise. In practice, the introduction of modulated fuel flow into the combustor effectively prevents the variations in the gas pressure from latching on to certain resonance frequencies at which the acoustic variations and noise are amplified to reach dangerous levels.

The fluidic oscillator device is preferably an astable (or "flip-flop") fluidic oscillator. It will be readily appreciated by the skilled person that the astable fluidic oscillator can be of any suitable configuration. As described above, astable fluidic oscillators have no moving parts which means that they are cheap to manufacture and very reliable.

In a preferred arrangement, the first and second outlet passages diverge from each other in a direction away from the junction and a control inlet communicates with the junction to effect diversion of fuel flow between the outlet passages. The second diverging outlet may be connected to the control inlet by a feedback line that introduces a time delay. The time delay may be increased by means such as a restrictor and/or a volume in the feedback line. The restrictor and/or the volume is/are preferably variable so that the time delay introduced by the feedback line can be varied.

The time delay introduced by the feedback line determines the oscillation frequency of the fluidic oscillator device.

The fluidic oscillator device can have a pair of oppositely facing control inlets communicating with the junction. In this arrangement each of the diverging outlets can be connected to one of the control inlets by a feedback line. As previously explained, each feedback line preferably includes a means such as a restrictor and/or a volume for introducing a time delay into communication between the second outlet and the control inlet, the restrictor and/or the volume preferably being variable so that the time delays can be varied. The time delays introduced by the feedback lines can be the same or different.

Alternatively, the second control inlet can be connected to the fuel supply line by a bypass line. The bypass line preferably includes a restrictor.

Some of the fuel is preferably supplied from the fuel supply line direct to the fuel discharge line through a bypass line. Hence, a first proportion of fuel for delivery to the combustor bypasses the fluidic oscillator device and a second proportion of fuel for delivery to the combustor passes through the fluidic oscillator device. The bypass line can include means for controlling the proportion of fluid fuel that flows along the bypass line, such as a variable restrictor and/or an adjustable valve.

The fuel can be a liquid or a gas.

The present invention also provides a method of modulating a rate of fuel flow into the combustor of a gas turbine engine, the method comprising the steps of:

supplying fluid fuel to the supply inlet of a fluidic oscillator device;

operating the fluidic oscillator device at an oscillation frequency to output fluid fuel alternately from first and second outlets of the device; and supplying to the combustor only the fluid fuel outputted from the first outlet.

The oscillation frequency of the fluidic device is preferably adjustable.

BRIEF DESCRIPTION OF THE DRAWINGS

The invention will now be described, by way of example only, with reference to the accompanying drawings, in which.

DETAILED DESCRIPTION OF EMBODIMENTS OF THE INVENTION

Figure 1:
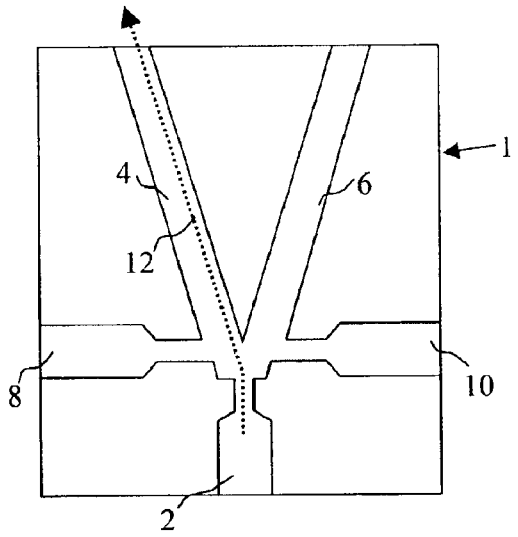
FIG. 1 is a schematic view of an astable (or "flip-flop") fluidic oscillator in accordance with the prior art.
Figure 2:
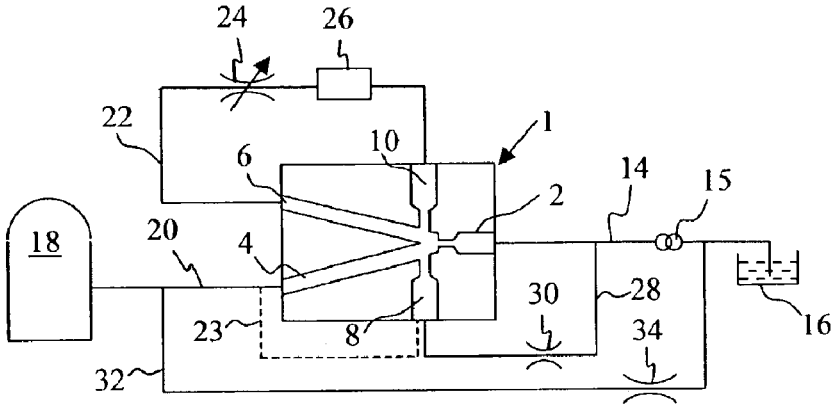
FIG. 2 is a schematic view of a fluidic apparatus in accordance with a first embodiment of the present invention.

The present invention will now be explained with reference to FIGS. 2 and 3. FIG. 2 shows a fluidic apparatus including an astable (or "flip-flop") fluidic oscillator 1 of the sort referred to above. The fluidic oscillator includes a supply inlet 2, a pair of diverging outlets 4, 6 and a pair of oppositely facing control inlets 8, 10.

A fluid fuel supply line 14 is connected between the supply inlet 2 and a fluid (liquid or gas) fuel source in the form of a fuel tank 16 of a gas turbine engine (not shown). Supply line 14 includes a pump 15 that supplies fluid fuel at a predetermined pressure to the fluidic oscillator 1.

The left-hand outlet 4 is connected to the combustor 18 of a gas turbine engine (not shown) by means of a fluid fuel discharge line 20.

The right-hand outlet 6 is connected to the right-hand control inlet 10 by means of a feedback line 22. The feedback line 22 includes a variable restrictor 24 and a downstream volume 26.

The left-hand control inlet 8 is connected to the fluid fuel supply line 14 by means of a first bypass line 28 that includes a restrictor 30. However, it will be readily appreciated by the skilled person that the left-hand control outlet 8 could alternatively be connected to the left-hand outlet 4 by means of a feedback line 23, shown as a dashed line, which like feedback line 22 could also include a variable restrictor and a volume, though these are not shown.

A second bypass line 32 is connected between the fluid fuel supply line 14 and the fluid fuel discharge line 20. Fluid fuel from the tank 16 is able to flow along the second bypass line 32 so that only a portion of the fluid fuel is supplied to the supply inlet 2 of the fluidic oscillator. The second bypass line 32 includes a restrictor 34, which may be variable if desired.

The operation of the fluidic apparatus will now be explained.

Fluid fuel from the tank 16 of the gas turbine engine is supplied to the supply inlet 2 of the fluidic oscillator 1 along the fluid fuel supply line 14 at a predetermined pressure from the pump 15.

It will be assumed that the supply jet (not shown) of fluid fuel from the supply inlet 2 initially attaches itself to the side wall of the right-hand outlet 6. The fluid fuel exits from the right-hand outlet 6 and passes along the feedback line through the variable restrictor 24 and into the volume 26. Once the volume 26 has been completely pressurized the fluid fuel is applied to the right-hand control inlet 10. This causes the supply jet of fluid fuel to attach itself to the side wall of the left-hand outlet 4 and the fluid fuel exits from the left-hand outlet. If the left-hand outlet 4 is connected to the left-hand control inlet 8 by a feedback line 23 then the above process will be repeated and the supply jet of fluid fuel will again attach itself to the side wall of the right-hand outlet 6. However, in the case of the preferred fluidic apparatus shown in FIG. 2, it is the fluid fuel supplied to the left-hand control inlet 8 along the first bypass line 28 that causes the supply jet of fluid fuel to re-attach itself to the side wall of the right-hand outlet 6. The supply jet therefore oscillates continuously so that it exits alternately from the left-hand outlet 4 and the right-hand outlet 6. The time delay introduced by the feedback line 22 as the fluid fuel flows through the variable restrictor 24 and fills the volume 26 determines the oscillation frequency of the astable fluidic oscillator 1. By adjusting the variable restrictor 24 it is possible to alter the oscillation frequency. The fluidic oscillator 1 is easily capable of operating at oscillation frequencies of 200 Hz or more.

The operation of the fluidic oscillator 1 means that fluid fuel is intermittently supplied to the fluid fuel discharge line 20 from the left-hand outlet 4. The rate of delivery of the fuel flow to the combustor 18 is therefore modulated in a controlled manner. However, only a proportion of the total fluid fuel supplied to the combustor 18 needs to be modulated. Most of the fluid fuel is therefore supplied directly to the combustor 18 from the fluid fuel source 16 along the second bypass line 32. The amount of fluid fuel supplied directly to the combustor 18 can be controlled either by restrictor 34 if it is made adjustable, or by an adjustable valve (not shown) in series with the restrictor.

Figure 3:
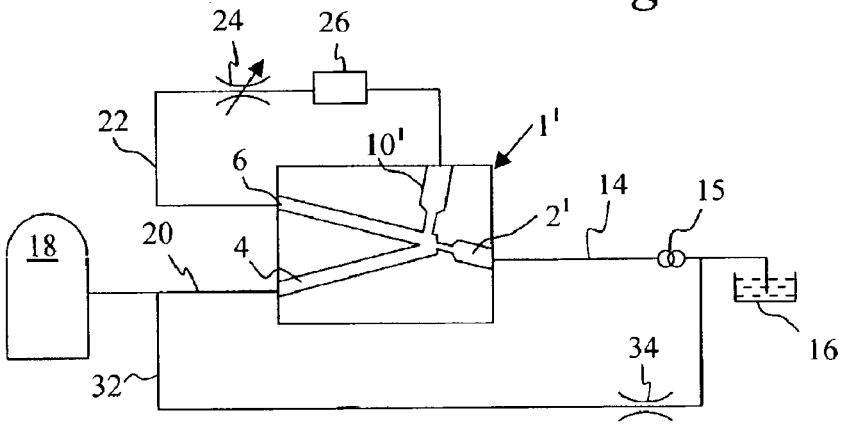
FIG. 3 is a schematic view of a fluidic apparatus in accordance with a second embodiment of the present invention.

FIG. 3 shows an alternative fluidic apparatus similar to that shown in FIG. 2, and like parts have been given the same reference numerals. The fluidic apparatus includes an astable (or "flip-flop") fluidic oscillator 1' of the sort referred to above. The fluidic oscillator 1' includes a supply inlet 2', a pair of diverging outlets 4, 6 and a control inlet 10'. The fluidic oscillator 1' does not have a second control inlet and this means that the fluid fuel exits alternately from the left-hand outlet 4 and the right-hand outlet 6 in an asymmetric manner. Flow attachment to the side wall of the right-hand outlet 6 is favored by virtue of the geometry of the pair of diverging outlets relative to the inlet 2', and the supply jet (not shown) only transfers to the left-hand outlet 4 when a control pressure is applied to the control inlet 10' through the feedback line 22.

It will be seen from the above description that the fluidic oscillator 1 or 1' acts to modulate the pressure/rate of delivery of fuel flow into the combustor 18. This can be used to prevent combustion noise frequencies or gas pressure variations from reaching dangerous levels due to being amplified at certain resonance frequencies of the combustion system. The coupling mechanism which is responsible for combustion instability is disrupted, thereby attenuating the variations in the gas pressure which cause the vibration and noise.

It will be understood that each of the elements described above, or two or more together, also may find a useful application in other types of constructions differing from the types described above.

While the invention has been illustrated and described as embodied in a fluidic control of fuel flow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A fluidic apparatus for modulating a rate of fluid fuel flowing from a fuel supply to a combustor of a gas turbine engine to attenuate vibration and noise in the combustor during combustion, comprising:

a) a fluidic oscillator device having a supply inlet passage in fluid communication with the fuel supply, a first outlet passage in fluid communication with the combustor, a second outlet passage, and a control inlet passage, all of the passages being in fluid communication with each other; and b) a fluidic control arrangement, including a feedback line in fluid communication between the second outlet passage and the control inlet passage, for diverting at least a portion of the fuel supplied to the supply inlet passage alternately between the first and second outlet passages at an oscillation frequency determined at least in part by the feedback line.

2. The fluidic apparatus according to claim 1, wherein the first and second outlet passages diverge away each other and meet the supply inlet passage at a common junction.

3. The fluidic apparatus according to claim 1, wherein the arrangement diverts the fuel portion continuously between the first and second outlet passages at the oscillation frequency.

4. The fluidic apparatus according to claim 1, wherein the feedback line includes means for introducing a time delay for the fuel portion diverted to the second outlet passage.

5. The fluidic apparatus according to claim 4, wherein the time delay means includes at least one of a flow restrictor and a volume.

6. The fluidic apparatus according to claim 4, wherein the time delay means includes means for adjusting the time delay to a desired value.

7. The fluidic apparatus according to claim 1, wherein the fluidic oscillator device has an additional control inlet passage in fluid communication with all of the passages, and wherein the arrangement includes an additional feedback line in fluid communication between the first outlet passage and the additional control inlet passage and operative for introducing a time delay for the fuel portion diverted to the first outlet passage.

8. The fluidic apparatus according to claim 7, wherein the additional feedback line includes at least one of a flow restrictor and a volume.

9. The fluidic apparatus according to claim 7, wherein the time delay introduced by the additional feedback line is variable.

10. The fluidic apparatus according to claim 1, wherein the fluidic oscillator device has an additional control inlet passage in fluid communication with all of the passages, and wherein the arrangement includes a bypass line in fluid communication between the supply inlet passage and the additional control inlet.

11. The fluidic apparatus according to claim 10, wherein the bypass line includes at least one of a flow restrictor and a volume for introducing a time delay for the fuel portion flowing along the bypass line.

12. The fluidic apparatus according to claim 1, wherein the arrangement includes a main bypass line connected between the fuel supply and the combustor to enable a remaining portion of the fuel to bypass the fluidic oscillator device.

13. The fluidic apparatus according to claim 12, wherein the main bypass line includes at least one of a flow restrictor and a volume for introducing a time delay for the remaining portion of the fuel flowing along the main bypass line.

14. The fluidic apparatus according to claim 13, wherein the time delay is variable.

15. The fluidic apparatus according to 12, wherein the main bypass line is operative for controlling a proportion of the fuel that flows along the main bypass line.

16. A method of modulating a rate of fluid fuel flowing from a fuel supply to a combustor of a gas turbine engine to attenuate vibration and noise in the combustor during combustion, comprising the steps of:

a) connecting a supply inlet passage of a fluidic oscillator device to the fuel supply;

b) connecting a first outlet passage of the device to the combustor;

c) enabling fluid communication between the supply inlet passage and the first outlet passage, as well as to a second outlet passage and a control inlet passage of the device; and d) diverting at least a portion of the fuel supplied to the supply inlet passage alternately between the first and second outlet passages at an oscillation frequency determined at least in part by a feedback line connected between the second outlet passage and the control inlet passage.

17. The method according to claim 16, wherein the diverting step is performed continuously.

18. The method according to claim 16, wherein the step of introducing a time delay in the feedback line.

19. The method according to claim 18, and the step of adjusting the time delay in the feedback line.

20. The method according to claim 16, and the step of bypassing the device by connecting a bypass line between the fuel supply and the combustor.

* * * * *